US009065256B2

(12) United States Patent
Makarov et al.

(10) Patent No.: US 9,065,256 B2
(45) Date of Patent: Jun. 23, 2015

(54) SHORT-CIRCUIT PREVENTION IN AN RF SPARK PLUG

(75) Inventors: Maxime Makarov, Viroflay (FR); Marc Pariente, Paris (FR)

(73) Assignee: RENAULT s.a.s., Boulogne-Billancourt (FR)

( * ) Notice: Subject to any disclaimer, the term of this patent is extended or adjusted under 35 U.S.C. 154(b) by 41 days.

(21) Appl. No.: 13/879,212

(22) PCT Filed: Oct. 6, 2011

(86) PCT No.: PCT/FR2011/052330

§ 371 (c)(1),
(2), (4) Date: May 28, 2013

(87) PCT Pub. No.: WO2012/049403

PCT Pub. Date: Apr. 19, 2012

(65) Prior Publication Data

US 2013/0234581 A1 Sep. 12, 2013

(30) Foreign Application Priority Data

Oct. 12, 2010 (FR) ..... 10 58282

(51) Int. Cl.

| | |
|---|---|
| ***H01T 13/34*** | (2006.01) |
| ***H01T 13/50*** | (2006.01) |
| ***H01T 13/52*** | (2006.01) |
| ***H01T 21/02*** | (2006.01) |

(52) U.S. Cl.

CPC ..... *H01T 13/34* (2013.01); *H01T 13/50* (2013.01); *H01T 13/52* (2013.01); *H01T 21/02* (2013.01)

(58) Field of Classification Search

CPC ..... H01T 13/34; H01T 21/02

USPC ..... 313/231.31, 141, 161

See application file for complete search history.

(56) References Cited

U.S. PATENT DOCUMENTS

| | | | | |
|---|---|---|---|---|
| 2,989,660 | A * | 6/1961 | Graham et al. | 313/130 |
| 2009/0033194 | A1 | 2/2009 | Jaffrezic et al. | |
| 2009/0091232 | A1 * | 4/2009 | Jaffrezic et al. | 313/141 |

FOREIGN PATENT DOCUMENTS

| | | |
|---|---|---|
| EP | 1 202 411 | 5/2002 |
| FR | 2 881 281 | 7/2006 |

OTHER PUBLICATIONS

International Search Report Issued Jan. 31, 2012 in PCT/FR11/52330 Filed Oct. 6, 2011.

* cited by examiner

*Primary Examiner* — Nimeshkumar Patel
*Assistant Examiner* — Jacob R Stern
(74) *Attorney, Agent, or Firm* — Oblon, McClelland, Maier & Neustadt, L.L.P.

(57) ABSTRACT

A spark plug including: a central electrode including an upper end and a lower end; an insulating part including an upper portion and a lower portion and surrounds the central electrode so that the lower end of the central electrode extends beyond the lower portion of the insulating part; and a cap including an upper portion and a lower portion that has an end section and that surrounds the insulating part so that the lower portion of the insulating part extends beyond the lower portion of the cap. The insulating part includes an annular groove, on the external periphery thereof, on the lower end of the cap, and the lower end section of the cap is placed in the groove.

16 Claims, 3 Drawing Sheets

SHORT-CIRCUIT PREVENTION IN AN RF SPARK PLUG

TECHNICAL FIELD TO WHICH THE INVENTION IS RELATED

The invention relates to radiofrequency plasma spark plugs. The invention relates more particularly to radiofrequency plasma spark plugs intended to be fitted in the combustion chambers of internal combustion engines and which comprise a central electrode of cylindrical shape consisting of a conductive material, which comprises an upper end and a lower end intended to be arranged in the combustion chamber, a component substantially tubular in shape, made of an electrically insulating material, which includes an upper part and a lower part, and which surrounds the central electrode over a portion of its length so that the lower end of the central electrode extends beyond the lower part of the insulating material component, a steel shell substantially tubular in shape, which includes an upper part and a lower part, and which surrounds the insulating material component over a portion of its length so that the lower part of the insulating material component extends beyond the lower part of the shell.

The terms upper and lower are used to designate the opposite sides of the spark plug. Lower end means the side of the spark plug intended to be arranged in the combustion chamber. Other terms may be substituted such as left/right or spark plug head for designating said side of the spark plug.

PRIOR ART

In order to reduce pollutant emissions, notably those of motor vehicles, the use of lean mixtures is known, i.e. gaseous mixtures with an excess of air in relation to the quantity of fuel. Ignition in the presence of a lean gas/fuel mixture is difficult to control. In order to increase the probability of successful ignition, two solutions present themselves which are: first, to have mixtures richer in fuel around the spark plug when the spark occurs, or second, to increase the extent of the sparks from the spark plug. New spark plugs have thus been developed in order to produce large sparks from reduced potential differences.

Radiofrequency plasma spark plugs, as referred to in the preamble of the invention, belong to these new spark plugs in forming high frequency multi-spark ignition systems capable of ensuring the ignition of spark-ignition engines fueled with lean gas mixtures.

In such spark plugs, the shell has a threaded part at the lower end of the electrode side, which enables the spark plug to be screwed into the threaded hole of the cylinder head.

Such spark plugs, also called branched plasma multi-spark plugs, can be used for the propagation of a plasma in a volume distant from the insulator surface. Spark creation then tends to be generated between a central electrode and the combustion chamber, in contact with the second electrode which is the shell of the spark plug. In such spark plugs, the combustion chamber is then considered from a functional point of view, as the second electrode of the ignition system. The two electrodes are separated by an insulator represented by a tubular component of insulating material, preferably ceramic, which surrounds the central electrode over a portion of its outer surface.

The publication FR2878086 describes this type of spark plug, wherein the insulating component between the electrodes has an annular shoulder masking the entire toric surface at the end of the shell leaving the end of the central electrode free. The purpose of this configuration is to reduce the risks of creating electrical discharges that start from the shell and are propagated along the insulating component along the axis of the central electrode. This method of obtaining discharges is actually undesirable because it reduces the efficiency of the spark plug. Variant embodiments can be used to reduce electric field enhancements notably by removing the right angles on said shoulder causing electric arcing between the insulating component and the shell, which is detrimental to the efficiency of the spark plug.

This architecture leads to manufacturing and assembly constraints, making it necessary, for example, to assemble the insulating material component in the shell in the opposite direction due to the shoulder at the end of the insulating component.

In the publication FR2881281, a plasma generating spark plug of the aforementioned type is disclosed of which the surface of the insulator facing the two electrodes is metalized.

Metalizing the insulator reduces the risks of electrical breakdown between the facing surfaces of the insulator and the electrodes. Indeed, due to the contact between the electrodes and the metalized surface of the insulator, the two facing surfaces are at the same potential, thereby preventing the creation of sparks in this area. However, problems arise at the edge of the metalization area on the isolator facing the shell. As ending the metalization just at the lower end of the shell it is difficult to control, two configurations appear that both lead to risks of electrical breakdown causing surface sparks between the central electrode and the shell:

- the metalization ends beyond the lower end of the shell. This sharp ending presents a "spiked point" enhancing the electric field and increases the risks of breakdowns occurring on the surface of the insulator between the central electrode and the grounded shell.
- the metalization ends before the lower end of the shell. This configuration may cause discharges between the insulator and the shell due to significant differences in potential and carries the risk of producing breakdown on the surface of the insulator between the central electrode and the shell.

SUBJECT MATTER OF THE INVENTION

The invention aims to remedy these drawbacks. To achieve this, the invention provides a multi-spark plug wherein the end of the shell on the side of the spark plug head is mechanically linked with the insulating component.

DISCLOSURE OF THE INVENTION

The invention thus relates to a spark plug intended to be fitted in a combustion chamber of an internal combustion engine and which comprises a central electrode of cylindrical shape consisting of a conductive material, which includes an upper end and a lower end, intended to be arranged in the combustion chamber, a component substantially tubular in shape, made of an electrically insulating material which includes an upper part and a lower part, and which surrounds the central electrode over a portion of its length so that the lower end of the central electrode extends beyond the lower part of the insulating material component, a shell made of conductive material, substantially tubular in shape which includes an upper part and a lower part comprising an end segment, and which surrounds the insulating material component over a portion of its length so that the lower part of the insulating material component extends beyond the lower part of the shell.

The invention is characterized in that the insulating material component comprises an annular groove on its outer periphery, at the lower end of the shell, and in that said component is metalized over its entire outer surface from its upper end up to the edge of the groove and in that the lower end segment of the shell is arranged in the groove. The end segment of the shell means a part of said shell located at the edge and extending for several millimeters.

The outer surface of the insulating component facing the shell is metalized in order to ensure electrical continuity between the insulating component and the shell. The aim is to prevent the creation of electrical discharges between the two facing surfaces. Thanks to the invention, the end segment is arranged in the groove for being thus inserted in part of the insulating component, and is accordingly masked with respect to the lower end of the central electrode. The problems associated with ending the metalization of the insulating component at the lower end of the shell are further reduced, or even eliminated.

According to one feature of the invention, the width and depth of the annular groove of the insulating component are adapted so that the free section of the lower end segment of the shell is entirely contained in the groove.

The groove dimensions are defined so that the lower end section of the shell is buried in the groove. The burying of said section ensures that the spark plug has good mechanical resistance to the pressure level in the combustion chamber, especially since it is achieved by mechanical deformation.

Advantageously, the annular groove of the insulating material component contains electrically insulating cement.

The cement promotes the contacts between the end of the shell once deformed and the insulating component. The aim is to ensure good heat dissipation from the insulating component toward the shell and toward the cylinder head, and also to ensure the tightness of the spark plug, while masking the end of the shell with respect to the central electrode.

Advantageously, the lower end segment of the shell is of reduced thickness.

The lower section of the end segment is intended to be embedded in the annular groove filled with cement. The reduced thickness of the segment facilitates the insertion of the segment, notably by deformation, and the embedding of the end section in the annular groove.

According to a preferred embodiment of the invention, the inner diameter of the lower part of the shell is substantially equal to the outer diameter of the lower part of the insulating material component.

These dimensional features facilitate the assembly of the insulating component.

Advantageously, the inner surface of the insulating component surrounding the central electrode is metalized.

The inner surface of the metalized insulating component and the central electrode are in contact and are therefore at the same potential.

Advantageously, the insulating component is of a single-body type and comprises two central bores of different diameters, the first for positioning an inductance coil, and the second for positioning the central electrode.

The number of components forming the spark plug is reduced and the assembly thereof is made easier.

In one embodiment of the spark plug according to the invention which is not limiting, the shell comprises a first bore in the upper part and a second bore in the lower part, which are coaxial and of different diameters, and the unit formed by the insulating material component and the central electrode is fitted into the shell via the upper part of the shell, and attached in the shell by bonding, with a deposit of preferably ceramic adhesive, in the bottom of the first bore of the upper part of the shell.

The shell comprises two bores of substantially different diameters, a first bore in the upper part of greater diameter than that of the second bore in the lower part. This configuration enables easy assembly by fitting the insulating component into the shell via the upper part of the shell. Bonding is preferably implemented by a deposit of adhesive in the bottom of the first bore in the upper part of the shell in order to ensure tight and homogeneous bonding.

The method of manufacturing the spark plug according to the invention comprises a step of filling the annular groove with preferably ceramic cement, followed by a step of mechanical deformation of the lower end segment of the shell toward the bottom of the groove.

The annular groove is filled with cement, then the end segment is deformed toward the bottom of the groove, which ensures good contact between the cement and the end segment of the shell.

Advantageously, the manufacturing method of the invention comprises a step of grinding the cement surface of the annular groove of the insulating component, after the cement has dried, for preventing any overlap of material.

The lower end section of the shell is cast in the groove filled with ceramic cement. After the cement has dried, the cement surface in the groove is ground in order to remove any sharp angle and obstacle and to reduce the risks of electric arc propagation on the lower end surface of the insulating component.

Advantageously, a conical induction coil comprising an upper part and a lower part with a spring socket at its lower end is inserted into the central bore in the upper part of the insulating component.

The conical bore in the upper part of the insulating component is adapted to accommodate the induction coil, making the assembly simple, while reducing the space requirement of the device.

Advantageously, the conical induction coil is attached to the insulating component by bonding on its outer peripheral surface.

Since the conical induction coil is introduced into the conical bore in the upper part of the insulating component, the adhesive on the peripheral surface of the coil ensures contact without a gap between the coil and the insulating component thanks to the conicity of the assembly, while ensuring the attachment of said coil with respect to the insulating component.

Advantageously, the spring socket is engaged on the upper end of the central electrode, at the end of sliding of the coil in the central bore of the insulating component.

The socket is adapted for being connected to the upper end of the central electrode, which simplifies the assembly of the unit.

Other features and advantages of the invention will become clearer in the following detailed description referring to the accompanying drawings, given solely by way of example for illustrating a preferred embodiment of this invention.

DISCLOSURE OF AN EMBODIMENT OF THE INVENTION

Figure 1:
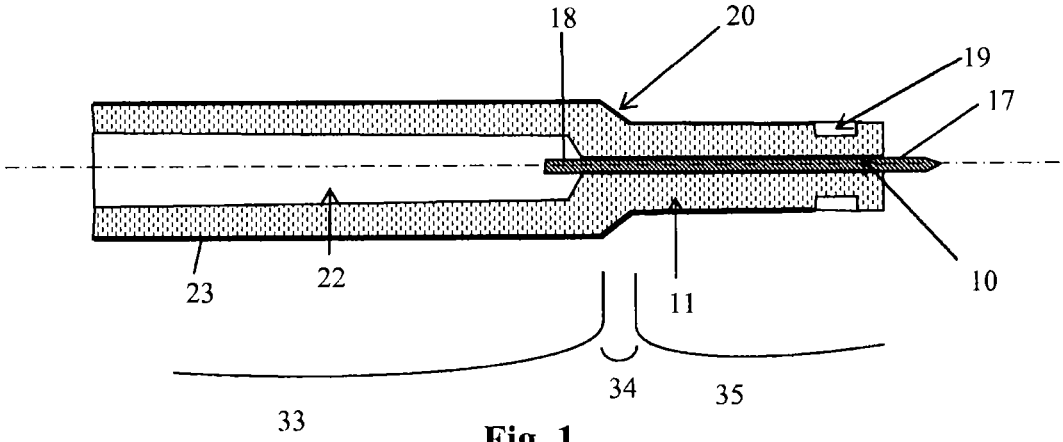
FIG. 1 schematically depicts a sectional view of an insulating component and a central electrode of a spark plug according to the present invention.

According to the invention, with reference to FIG. 1, an electrode 10 of substantially cylindrical shape made of conducting material, and including an upper end 18 and a lower end 17 intended to be in contact with the gas mixture, is maintained by any means (brazing, bonding, sintering, etc.) ensuring a tight contact, in a bore of an insulating component 11 so that the lower end 17 of the electrode extends beyond the component 11.

The insulating component 11 is of a single-body type and comprises two end segments 33 and 35 of a substantially tubular shape and different outer diameters and a third segment 34 forming the connection between the two segments 33 and 35. The first segment 35 surrounds the central electrode 10 over a portion of its outer surface, and has an annular groove 19 near the lower end 17 of the central electrode 10. The second segment 33 of a substantially larger outer diameter comprises a slightly conical inner bore 22. The average diameter of this bore is substantially larger than the outer diameter of the central electrode 10. The inner bore is made such that the upper end 18 of the central electrode 10 runs into this bore.

The entire outer surface of the segments 33 and 34 of the insulating component 11 is covered with a layer of metal material. Since the outer surface of the segment 35 is metalized from its junction with the segment 34 up to the edge of the annular groove 19, metalization of a part of the groove is tolerated as it has no effect on the operation of the spark plug.

Figure 2:
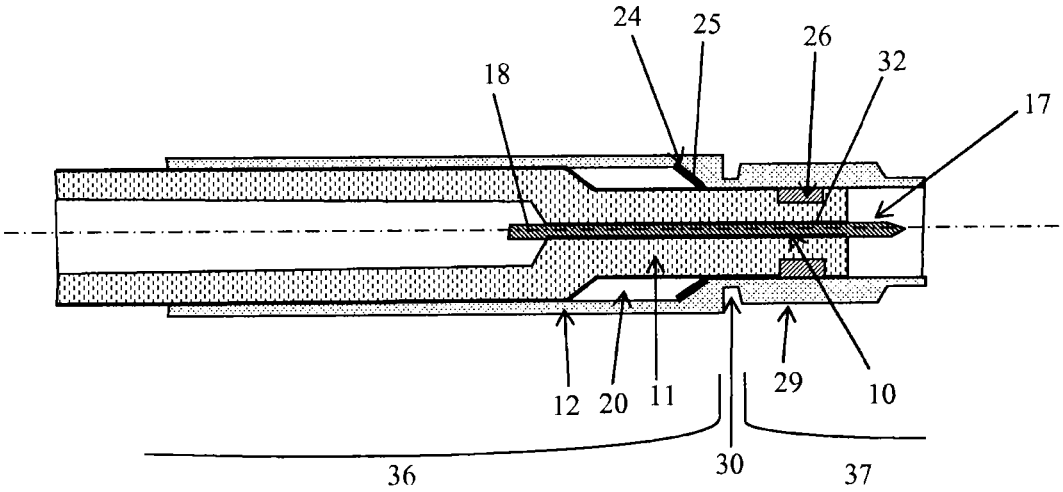
FIGS. 2 and 3 schematically depict a sectional view of the positioning of the insulating component in a spark plug shell.
Figure 3:
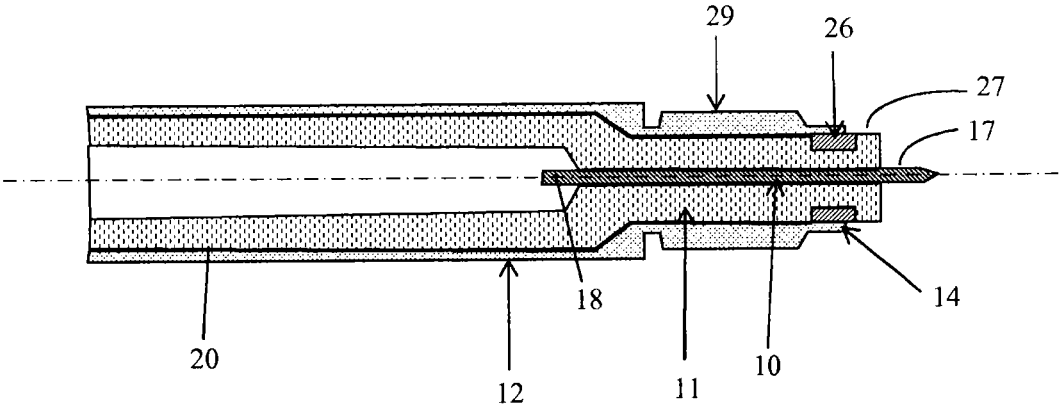

Advantageously, the inner surface 32 of the insulating component 11 surrounding the central electrode, as shown in FIGS. 2 and 3, may be covered with a layer of metal material.

The insulating component 11 is fitted into a casing of metal material such as steel which comprises two bores of different diameters for surrounding the segments 33 to 35 of the insulating component.

This steel casing is the shell 12 of the spark plug and comprises two segments 36 and 37 of substantially different outer diameters, separated by a groove 30. The segment 36 has an outer diameter greater than that of the segment 37. The outer surface 29 of the segment 37, except for the end segment 14, is threaded. The latter comprises a thinner lower end segment 14, as will be explained later.

The assembly of the insulator 11 and the electrode 10 in the shell 12 is illustrated in FIG. 2. A subunit formed of the insulating component 11 and the electrode 10 is introduced via the free end of the segment 36 of the shell 12 and pushed into a bore 20 toward the inner end of the segment 36, the bottom of this bore takes the beveled shape of the connecting segment 34 of the insulating component 11. An adhesive layer 25 is preferably arranged on the bottom 24 of this bore in order to ensure the attachment of the insulating component 11 to the shell 12. The deposit of adhesive on the bottom of the first bore 20 of the shell ensures a tight and homogeneous bonding. After assembly, the spark plug 1 has the structure illustrated in FIG. 3 wherein the lower end segment 14 of the shell 12 is arranged at the annular groove 19.

Figure 4:
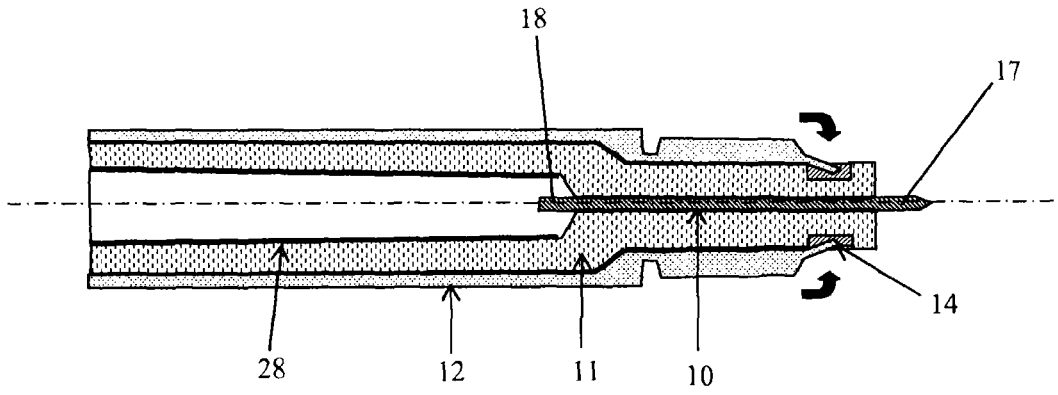
FIG. 4 schematically depicts a sectional view of the step of deforming the end of the shell.

Moreover, referring to FIG. 4, the annular groove 19 is previously filled with uncured ceramic cement 26.

According to an important aspect of the invention, the width and depth of the annular groove 19 of the insulating component are adapted for receiving the end section of the segment 14 of the shell 12 in its entirety. The lower end segment 14 of the shell 12, having a reduced section, is then mechanically deformed toward the bottom of the groove 19, preferably by hot or cold crimping, which ensures good mechanical strength of the subunit formed of the shell 12 and the insulating component 11.

The dimensions of the groove are adapted so that the end section of the segment 14 of the shell is completely cast in the cement of the groove after deformation, so that no part of the end section of the segment 14 remains on the outer surface of the insulating component 11 in order to reduce the risks of electric arcing. End section means the end axial surface of the segment. The excess ceramic cement 26 arising from this operation is removed. The surface of the groove 19, filled with the ceramic cement, is ground after the cement has set.

The ceramic cement 26 thus ensures very good contact between the insulating component 11 and the shell 12 and also the dissipation of heat from the insulating component 11 toward the shell 12. The ceramic cement 26 also ensures the tightness of the spark plug 1 thus formed.

The spark plug according to the invention comprises a lower end wherein the central electrode extends beyond the insulating component 11, the latter having tight contacts with the central electrode and the shell, which also serves to attach the spark plug in the cylinder head. The lower end section of the shell is embedded in the groove defined in the insulating component. A cement, preferably ceramic, covers the groove and ensures excellent contact between the insulating component and the lower segment of the shell.

This configuration greatly reduces the risks, resulting from ending the metalization of the outer surface of the insulating component facing the shell, of breakdowns between the insulating component and the shell and of discharges being produced on the surface of the insulator between the central electrode and the shell.

This configuration also ensures good mechanical resistance of the lower end of the spark plug, or spark plug head, intended to be arranged in the combustion chamber, against high pressures, which may exceed 100 bar.

This configuration also ensures a good transfer of heat from the electrode toward the insulating component, then toward the shell and the cylinder head.

The fitting and assembly of the rest of the spark plug are described (by way of example) in FIGS. 5 to 8, according to a preferred embodiment.

Figure 5:
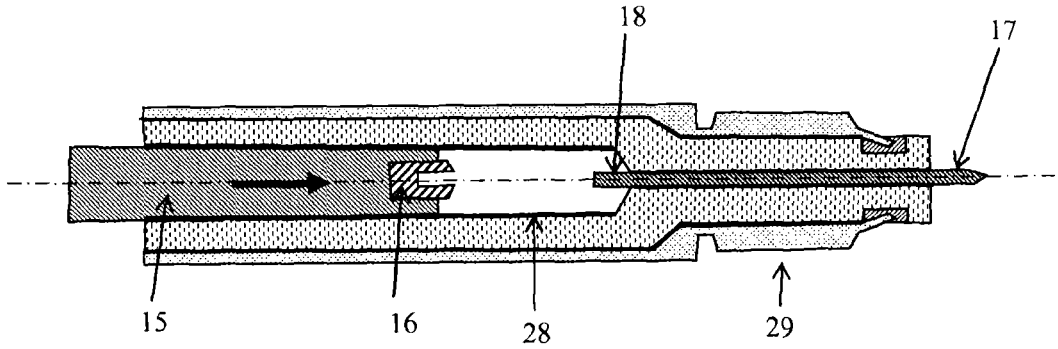
FIG. 5 schematically depicts a sectional view of the spark plug during the connection of an induction coil.

Referring to FIG. 5, a coil 15 is wound onto a conical mandrel having substantially the same angle as the bore 22 of the second segment 33 of the insulating component, approximately 1 to 2°, and which is shaped for ensuring play-free contact with the insulating component 11. This coil 15 is thus introduced into the bore 22. It advantageously comprises a spring socket 16 arranged in front of the coil in the direction of introduction of said coil, the inner diameter of the socket being adapted to the diameter of the upper end 18 of the central electrode, and the socket being electrically connected to the coil.

According to one implementation of the invention, the wall 28 of the bore 22 in the second segment 33 of the insulating component is covered with adhesive, preferably an impregnating resin, for attaching the inductive coil 15 to the insulating component 11, without play between the coil 15 and the insulating component 11. Thus, at the end of sliding of the coil 15 in the bore 22, the socket is mechanically connected to the upper end 18 of the central electrode 10, thereby ensuring the electrical connection between the electrode 10 and the coil 15. As a variant, the adhesive may be arranged on the coil, or on both components to be bonded.

Figure 6:
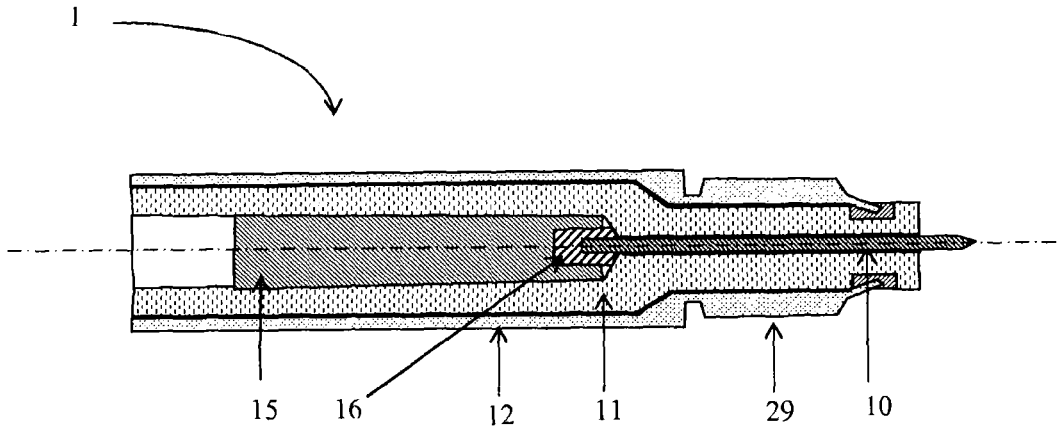
FIG. 6 schematically depicts a sectional view of the assembled spark plug.

The assembled spark plug is illustrated in FIG. 6.

Figure 7:
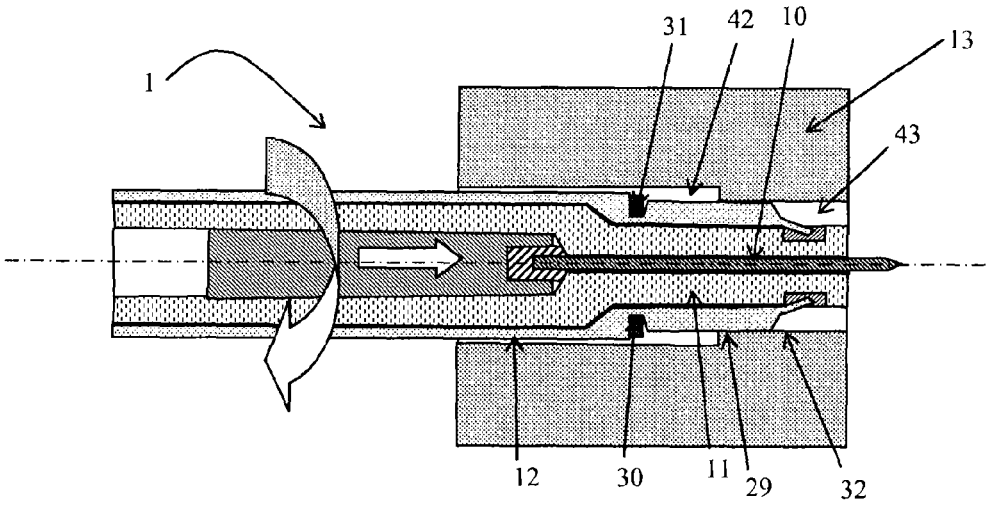
FIGS. 7 and 8 schematically depict a sectional view of the multi-spark plasma plug according to the invention during the step of connecting into the cylinder head.
Figure 8:
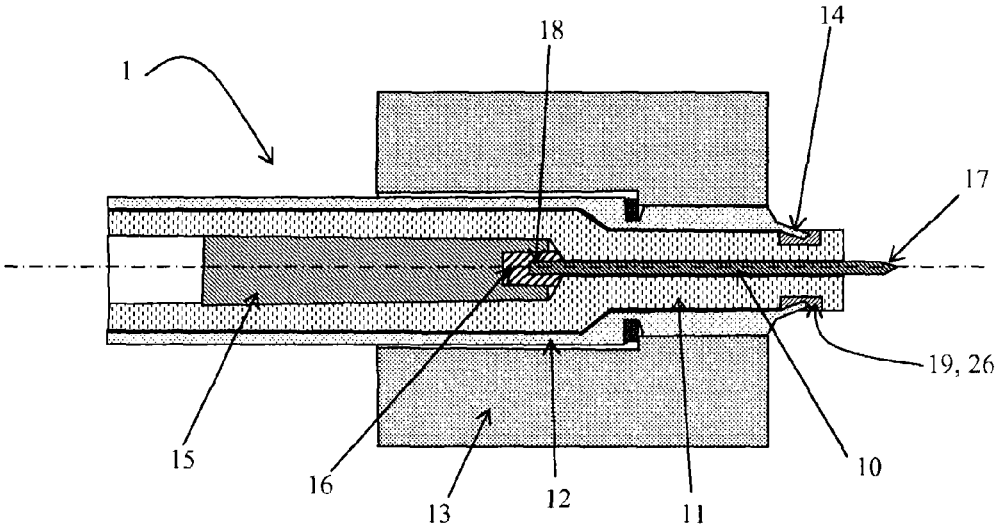

FIGS. 7 and 8 illustrate the positioning of said spark plug 1 in a cylinder head 13. A tightness seal 31, preferably of metal, is placed in the groove 30 of the shell 12 for ensuring the tightness of the assembly. The cylinder head 13 has a bore 42 in the upper part and a bore 43 in the lower part, opening into the combustion chamber, with different diameters. The bore in the lower part is threaded and intended to accommodate the lower threaded part 37 of the shell. The spark plug 1 is screwed into the bore 43 of the cylinder head 13, until the O-ring 31 comes to rest on the bottom of the upper bore 42. The spark plug is thus attached in the cylinder head 13 with the lower end of the electrode 10 in the combustion chamber, in contact with the gas mixtures.

The outer diameter of the lower segment 35 of the insulating component 11 is less than the inner diameter of the shell 12, which enables assembly of an insulating component of a single-body type. This assembly is done simply by fitting and attachment by bonding.

The invention is not limited to the various embodiments described above.

The invention may be adapted on spark plugs of which the insulating component is not of a single-body type.

The insulating material of the insulating component is preferably a ceramic having a breakdown voltage greater than 20 kV/mm.

The metalization of the inner and outer surfaces of the insulating component is done by any metalization method, e.g. by the application of silver- or metal alloy-based metal layers, by brush or by spraying and drying, then passing the insulating component into a reducing atmosphere furnace.

The metalization of the outer surfaces of the insulating component may be applied only onto the segments 34 and 35, surrounding the central electrode 10. The outer surface of the second segment 33 of the insulating component may be surrounded by a casing of conductive material, preferably copper- or silver- or aluminum- or gold-based.

The ceramic cement may be an alumina powder-based product.

Furthermore, the lower end of the central electrode arranged in the combustion chamber may be shaped differently.

The invention claimed is:

1. A spark plug configured to be fitted in a combustion chamber of an internal combustion engine, comprising:

a central electrode of cylindrical shape including a conductive material, which includes an upper end and a lower end configured to be arranged in the combustion chamber;

an insulating material component substantially tubular in shape, made of an electrically insulating material that includes an upper part and a lower part, and which surrounds the central electrode over a portion of its length so that the lower end of the central electrode extends beyond the lower part of the insulating material component;

a shell made of conductive material, substantially tubular in shape that includes an upper part and a lower part, the lower part of the shell comprising an upper end segment adjacent to the upper part of the shell and a lower end segment opposite to the upper end segment, and the shell surrounds the insulating material component over a portion of its length so that the lower part of the insulating material component extends beyond the lower part of the shell;

wherein the insulating material component comprises an annular groove, on its outer periphery, spaced apart axially from a lower end of the lower part of the insulating material component, the insulating material component is covered with a layer of metalized material over its entire outer surface from its upper end up to an edge of the groove, and the lower end segment of the shell is arranged in the groove.

2. The spark plug as claimed in claim 1, wherein the lower end segment of the shell is arranged in the groove by mechanical deformation.

3. The spark plug as claimed in claim 1, wherein a width and depth of the annular groove of the insulating component are configured so that an axial end surface of the lower end segment of the shell is entirely contained in the groove.

4. The spark plug as claimed in claim 1, wherein the annular groove of the insulating material component includes electrically insulating cement.

5. The spark plug as claimed in claim 1, wherein the lower end segment of the shell is of reduced thickness compared with the rest of the lower part of the shell.

6. The spark plug as claimed in claim 1, wherein an inner diameter of the lower part of the shell is substantially equal to an outer diameter of the lower part of the insulating material component.

7. The spark plug as claimed in claim 1, wherein an inner surface of the insulating component facing the central electrode is metalized.

8. The spark plug as claimed in claim 1, wherein the insulating component is of a single-body type and comprises first and second central bores of different diameters, the first central bore for positioning an inductance coil, and the second central bore for positioning the central electrode.

9. The spark plug as claimed in claim 1, wherein an outer surface of the lower end segment of the shell does not include threads.

10. A method of manufacturing a spark plug comprising:

a central electrode, including a conductive material, of cylindrical shape including a conductive material, which includes an upper end and a lower end;

a component substantially tubular in shape, made of an electrically insulating material that includes an upper part and a lower part, which surrounds the central electrode over a portion of its length so that the lower end of the central electrode extends beyond the lower part of the insulating material component, and which comprises an annular groove on the outer periphery of the lower part and spaced apart axially from a lower end of the lower part of the insulating material component;

a shell made of conductive material, substantially tubular in shape that includes an upper part and a lower part, the lower part of the shell comprising an upper end segment adjacent to the upper part of the shell and a lower end segment opposite to the upper end segment, and the shell surrounds the insulating material component over a portion of its length so that the lower part of the insulating material component extends beyond the lower part of the shell;

wherein:

the shell comprises a first bore in the upper part and a second bore in the lower part, which are coaxial and of different diameters;

the method comprising:

covering the outer surface of the insulating component with a metal layer from its upper part up to the edge of the annular groove;

fitting a unit formed by the insulating component and the central electrode into the shell via the upper end of the shell, and attaching the unit in the shell by bonding, or with a deposit of ceramic adhesive, in a bottom of the first bore of the upper part of the shell;

mechanically deforming the lower end segment of the shell to position the lower end segment of the shell in the groove.

11. The method of manufacturing a spark plug as claimed in claim 10, further comprising filling the annular groove with ceramic cement.

12. The method of manufacturing a spark plug as claimed in claim 11, further comprising grinding the cement surface of the annular groove of the insulating component, after the cement has dried, for preventing any overlap of material.

13. The method of manufacturing a spark plug as claimed in claim 10, wherein a conical induction coil comprising an upper part and a lower part with a spring socket at its lower end is inserted into the conical central bore in the upper part of the insulating component.

14. The method of manufacturing a spark plug as claimed in claim 13, wherein the conical induction coil is attached to the insulating component by bonding on its outer peripheral surface.

15. The method of manufacturing a spark plug as claimed in claim 14, wherein the spring socket is engaged on the upper end of the central electrode, at the end of sliding of the coil in the central bore of the insulating component.

16. The method of manufacturing a spark plug as claimed in claim 10, wherein the mechanically deforming the lower end segment of the shell includes positioning an axial end surface of the lower end segment of the shell entirely in the groove.

* * * * *